US008821594B2

(12) United States Patent
Burgazli et al.

(10) Patent No.: US 8,821,594 B2
(45) Date of Patent: Sep. 2, 2014

(54) SYNERGISTIC ADDITIVE COMPOSITION FOR PETROLEUM FUELS

(75) Inventors: Cenk R. Burgazli, Middletown, DE (US); Cyrus P. Henry, Jr., Avondale, PA (US)

(73) Assignee: Innospec Fuel Specialities LLC, Newark, DE (US)

( * ) Notice: Subject to any disclaimer, the term of this patent is extended or adjusted under 35 U.S.C. 154(b) by 744 days.

(21) Appl. No.: 12/441,069

(22) PCT Filed: Sep. 27, 2006

(86) PCT No.: PCT/US2006/037256

§ 371 (c)(1),
(2), (4) Date: Jun. 30, 2009

(87) PCT Pub. No.: WO2008/033146

PCT Pub. Date: Mar. 20, 2008

(65) Prior Publication Data

US 2010/0031559 A1 Feb. 11, 2010

Related U.S. Application Data

(63) Continuation-in-part of application No. PCT/US2006/035318, filed on Sep. 12, 2006.

(51) Int. Cl.
*C10L 1/18* (2006.01)

(52) U.S. Cl.
USPC ..... 44/350; 44/352; 44/369; 44/370; 44/389; 44/422

(58) Field of Classification Search
USPC ..... 44/342, 347, 379, 385, 388, 389, 418, 44/435, 439, 350, 352, 369, 370, 422
See application file for complete search history.

(56) References Cited

U.S. PATENT DOCUMENTS

| | | | | |
|---|---|---|---|---|
| 3,677,725 | A * | 7/1972 | Andress | 44/393 |
| 3,811,848 | A * | 5/1974 | Johnson | 44/351 |
| 6,458,174 | B1 | 10/2002 | Krull et al. | |
| 6,793,695 | B2 | 9/2004 | Wilkes et al. | |
| 7,189,269 | B2 * | 3/2007 | Clark et al. | 44/388 |
| 2004/0123517 | A1 | 7/2004 | Caprotti et al. | |

OTHER PUBLICATIONS

International Search Report and Written Opinion of the International Searching Authority dated, Jul. 18, 2008 for related International Patent Applicatoin PCT/US2006/035318 filed on Sep. 12, 2006.
International Search Report and Written Opinion of the International Searching Authority, dated, Jul. 1, 2009 from corresponding International Patent Application No. PCT/US06/037256.

* cited by examiner

*Primary Examiner* — Cephia D Toomer
(74) *Attorney, Agent, or Firm* — Burns & Levinson, LLP; Janine M. Susan

(57) ABSTRACT

Disclosed herein is a fuel oil composition with enhanced conductivity. The oil composition comprises a Petroleum Based Component and a combination of Lubricity and Conductivity additives. In one aspect, additional additives can be added such as: (a) low temperature operability/cold flow additives, (b) corrosion inhibitors, (c) cetane improvers, (d) detergents, and (e) dyes and markers (f) anti-icing additives, (g) demulsifiers/anti haze additives, (h) antioxidants, (i) metal deactivators, (j) biocides, and (k) thermal stabilizers. Further, the present disclosure describes a method of using such composition is described.

14 Claims, 3 Drawing Sheets

SYNERGISTIC ADDITIVE COMPOSITION FOR PETROLEUM FUELS

CROSS-REFERENCE TO RELATED APPLICATIONS

This application claims priority of International Application No. PCT/US06/35318, filed Sep. 12, 2006, which is incorporated herein in its entirety by reference.

FIELD OF THE INVENTION

This invention relates generally to fuel oil compositions, and more particularly, relates to a synergistic blend of conductivity and lubricity additives to increase hydrocarbon conductivity. The invention further relates to a method of using such compositions.

BACKGROUND OF THE INVENTION

One critical issue confronting the fuel market is the introduction of Ultra Low Sulfur (ULS) fuels. The processes used to diminish sulfur content of fuels also impact other fuel properties. Fuel properties which are directly impacted by changes in fuel composition are fuel Electrostatics and fuel Lubricity.

The lubricity characteristic of a fuel affects engine and engine component durability, whereas the electrostatic characteristics affect risks associated with Static Discharge Ignitions (SDI). While the effect on mechanical durability by a fuel is an important consideration, the effect on safety of personal handling a fuel with increased probability of SDI is paramount.

The risks associated with SDI are well documented. In the 1980's and 1990's the American Petroleum Institute (API) compiled reports of road tanker explosions in Europe following the introduction of Low Sulfur Diesel (LSD), despite the use of grounding leads. These incidents were specifically attributed to static charge induced ignition of fuel vapor during fuel transfer operations.

Electrostatics:

It is widely known that electrostatic charges can be frictionally transferred between two dissimilar, nonconductive materials. When this occurs, the electrostatic charge thus created appears at the surfaces of the contacting materials. The magnitude of the generated charge is dependent upon the nature of and, more particularly, the respective conductivity of each material. The potential for electrostatic ignition and explosion is probably at its greatest during product handling, transfer, and transportation.

Electrostatic charging is known to occur during solvent or fuel pumping operations. In such operations, the flow of low conductivity liquid through conduits with high surface area or through "fine" filters combined with the disintegration of a liquid column and splashing during high speed tank loading can result in static charging. Such static charging can result in electrical discharge (spark) with catastrophic potential in highly flammable environments.

Thus, situations which are of greatest interest to the petroleum industry are conditions where charge builds up in or around flammable liquids and the possibility of discharge leading to incendiary sparking, and perhaps to a serious fire or explosion.

Countermeasures designed to prevent accumulation of electrostatic charges on a container being filled such as container grounding (i.e., "earthing") and bonding are routinely employed. However, it has been recognized that grounding and bonding alone are insufficient to prevent electrostatic build-up in low conductivity organic liquids.

Organic liquids such as distillate fuels (diesel, gasoline, jet fuel, turbine fuels, home heating fuels, and kerosene), and relatively contaminant free light hydrocarbon oils (organic solvents and cleaning fluids) are inherently poor conductors. Static charge accumulates in these fluids because electric charge moves very slowly through these liquids and can take a considerable time to reach a surface which is grounded. Until the charge is dissipated, a high surface-voltage potential can be achieved which can create an incendiary spark, resulting in an ignition or an explosion.

The risk of static discharge ignition is further compounded by the newly enacted legislation designed to improve emissions characteristics from combustion of fossil fuels.

In order to meet emissions and fuel efficiency goals, automotive Original Equipment Manufacturers (OEM's) are investigating the use of NOx traps, particulate traps and direct injection technologies. Such traps and catalyst systems tend to be intolerant to sulfur. This coupled with the demonstrated adverse environmental consequences of burning sulfur rich fuels has resulted in a global effort to reduce the sulfur content of fuels (Reference World-Wide Fuel Charter, April 2000, Issued by ACEA, Alliance of Automobile Manufacturers, the entire teaching of which is incorporated herein by reference). These low sulfur and ultra-low sulfur fuels are becoming increasingly necessary to ensure compliance with emissions requirements over the full useful life of the latest technological generation of vehicles. Governments are also introducing further legislation for the reduction in particulate matter and fuel emissions.

In the United States, the Environmental Protection Agency (EPA) regulations require the sulfur content of on road fuel to meet Ultra Low Sulfur specification, specifically less than 15 ppm by mass of sulfur in the finished fuel. Similar regulations are also in place globally.

The method most commonly utilized to reduce the sulfur content of fuels is described as hydro treating. Hydro treating is a process by which hydrogen, under pressure, in the presence of a catalyst, reacts with sulfur compounds in the fuel to form hydrogen sulfide gas and a hydrocarbon. However, hydro treating to reduce sulfur content results not only in the removal of sulfur from the fuel but also the removal of other polar compounds which normally increase the conductivity characteristics of the fuel.

Generally, a non-hydro treated fuel has conductivity in the range of about 10 to about 30 $pS/m^2$, whereas, a hydro treated fuel (below 15 ppm limit) is normally below 1 $pS/m^2$. Conductivity below <3 pS/m greatly increases the risk of catastrophic electrostatic ignition. (Kattenwinkel, H. D., Electrical Conductivity, will a minimum level be required for all low S fuels in the future, 2nd CEN/TC 19 Symposium Automotive Fuels, 2003. Walmsley, H. L. An assessment of electrostatic ignition risks and filling rules for loading road tankers with low sulfur diesel, Institute of Petroleum, November 2000; the entire teachings of which are incorporated herein by reference).

In order to correct the detrimental effects of hydro treating, refineries and fuel handlers are routinely utilizing Static Dissipaters/Conductivity Improvers. These additives when used properly minimize the risk of electrostatic ignition in hydrocarbon fuels and solvents.

There is a great wealth of knowledge and experience regarding the use of Static Dissipaters/Conductivity Improver additives (ASTM D-4865 Standard Guide for Generation and Dissipation of Static Electricity in Petroleum Fuel Systems, and API Recommended Practice 2003—Protection Against Ignition Arising Out Of Static, Lightening, and Spray Currents; the entire teachings of which are incorporated herein by reference). The diversity of additives which have been patented and utilized in the fuel industry exemplifies the importance of risk associated with ignition due to static discharge.

The EPA ULS regulation and hydro treating required to meet sulfur requirements also greatly impacts lubricity properties of the fuels.

Fuel lubricity is the ability of the fuel to prevent wear on contacting metal surfaces. Certain diesel engine designs rely on fuel as a lubricant for their internal moving components. The problem of poor lubricity in these fuels is likely to be exacerbated by future engine system developments aimed at further decreasing emissions. This will result in an increase in the fuel oil lubricity requirement relative to requirements for present engines. For example, the use of high pressure unit injectors will likely increase the need for better fuel oil lubricity. Fuel lubricity requirements can be achieved by the use of lubricity additives.

As a consequence of the refinery processes employed to reduce Diesel sulfur and aromatics content, the majority of ultra-low sulfur Diesel fuels marketed today will require treatment with additives to restore fuel lubricity and fuel electrical conductivity.

Many additive producers and additive users are combining lubricity and conductivity additives into multipurpose packages to address the low lubricity and low conductivity problems associated with ULS fuels. Ostensibly, these combination packages not only delivering the required additives, but also, should enable the additive user to eliminate the requirement of maintaining two separate additive addition pumps and storage containers—however, these combination packages fall short of the desired product.

The pump systems utilized by the fuel industry to deliver additives into fuels have great difficulty in accurately delivering these additives at such low treatment rates. Therefore, fuel handlers using a single additive (conductivity) package are commonly required to make dilutions of the additive (usually with hydrocarbon solvents or fuels) prior to injecting the conductivity additive into the fuel.

In the combined packages, the dilution of the conductivity additive is achieved by utilizing the lubricity additive as the diluent. The lubricity additive can be used as a diluent because generally the amount of lubricity additive required to treat a fuel is generally 50 to 100 times the amount of conductivity additive required to treat the same fuel.

The regular practice in the oil refining and fuel additives industries of combining two or more additives to provide a multipurpose package comes with certain precautions and requirements.

It is, therefore, critical (especially with great safety concerns attributed to low conductivity) that the additives present in the fuel not only correct the specific fuel problems, or enhance the desired fuel attribute for which their addition is intended, but also, that the additives do not have a detrimental effect on other fuel properties, or on the performance of other additives present in the fuel. This requirement is commonly referred to as "No Harm". The fuel and additives industries have developed a wide range of tests to evaluate the "no-harm" performance of additive packages and components. An example of such a testing protocol is ASTM D-4054, *Evaluating the Compatibility of Additives with Aviation-Turbine Fuels and Aircraft Fuel System Materials*, the entire teaching of which is incorporated herein by reference.

The present invention addresses the deficiencies of the prior art and the current and future requirements (Lubricity and Conductivity) associated with modern fuels.

BRIEF SUMMARY OF THE INVENTION

The present invention describes fuel oil compositions with enhanced conductivity for use as a fuel. The oil compositions comprise a Petroleum Based Component and a combination of Lubricity and Conductivity additives. In one aspect, additional additives can be added such as: (a) low temperature operability/cold flow additives, (b) corrosion inhibitors, (c) cetane improvers, (d) detergents, (e) dyes and markers (f) anti-icing additives, (g) demulsifiers/anti haze additives, (h) antioxidants, (i) metal deactivators, (j) biocides, and (k) thermal stabilizers The invention further describes a method of using such compositions formulations.

Figure 1:
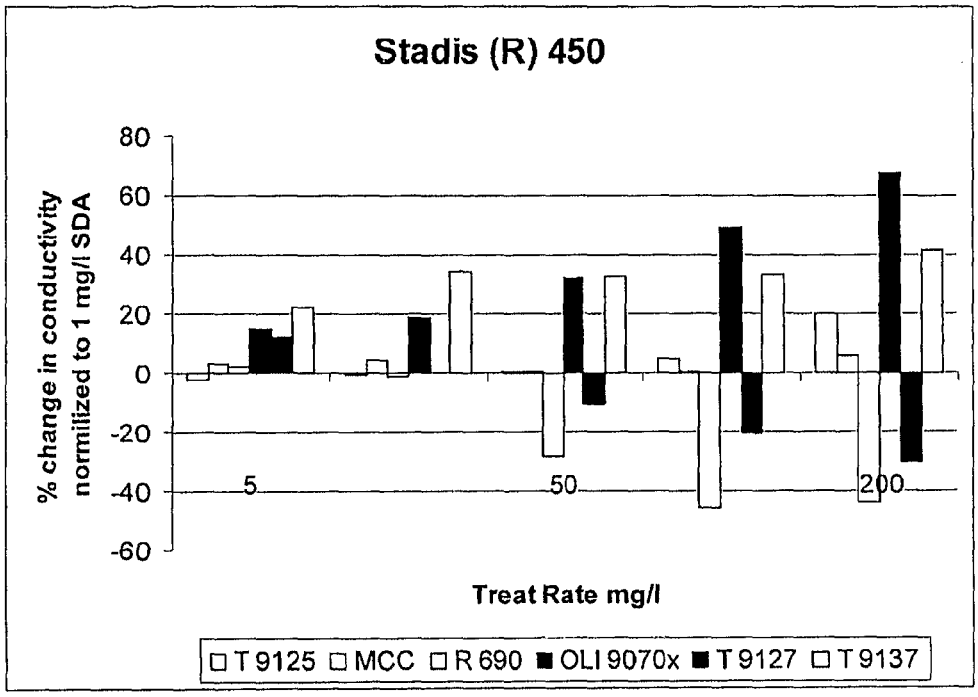
FIG. 1 is a graphical representation of the affect of lubricity additives on Stadis® 450 conductivity response.

In describing the embodiments of the present invention, specific terminology will be resorted to for the sake of clarity. However, it is not intended that the invention be limited to the specific term so selected, and it is to be understood that each specific term includes all technical equivalents which operate in a similar manner to accomplish a similar purpose. The technical equivalence of the additional terms will be readily recognized by a person who is skilled in the art pertaining to this invention.

DETAILED DESCRIPTION OF THE INVENTION

The present invention is directed to fuel oil compositions, comprising a Petroleum Based Component, and a synergistic combination of Lubricity and Conductivity additives. This synergistic combination of Lubricity and Conductivity additives increases the conductivity of petroleum fluids. Disclosed herein are methods directed toward the utilization of such a synergistic combination.

In one embodiment, the invention describes a fuel oil composition for use as, e.g., a fuel in diesel engines. The composition comprises a Petroleum Based Component, and a synergistic combination of Lubricity and Conductivity additives.

In the present embodiment, Petroleum Based Component is a hydrocarbon derived from refining petroleum or as a product of Fischer-Tropsch processes (well known to those skilled in the art). The hydrocarbon may also be a solvent. The fuel products are commonly referred to as Petroleum Distillate Fuels.

Petroleum Distillate Fuels encompass a range of distillate fuel types. These distillate fuels are used in a variety of applications, including automotive diesel engines and in non on-road applications under both varying and relatively constant speed and load conditions.

Petroleum Distillate Fuel oils can comprise atmospheric or vacuum distillates. The distillate fuel can comprise cracked gas oil or a blend of any proportion of straight run or thermally or catalytically cracked distillates. The distillate fuel in many cases can be subjected to further processing such hydrogen-treatment or other processes to improve fuel properties. The material can be described as a gasoline or middle distillate fuel oil.

Gasoline is a low boiling mixture of aliphatic, olefinic, and aromatic hydrocarbons, and optionally, alcohols or other oxygenated components. Typically, the mixture boils in the range from about room temperature up to about 225° C.

Middle distillates can be utilized as a fuel for locomotion in motor vehicles, air planes, ships and boats as burner fuel in home heating and power generation and as fuel in multi purpose stationary diesel engines.

Engine fuel oils and burner fuel oils generally have flash points greater than 38° C. Middle distillate fuels are higher boiling mixtures of aliphatic, olefinic, and aromatic hydrocarbons and other polar and non-polar compounds having a boiling point up to about 350° C. Middle distillate fuels generally include, but are not limited to, kerosene, jet fuels, and various diesel fuels. Diesel fuels encompass Grades No. 1-Diesel, 2-Diesel, 4-Diesel Grades (light and heavy), Grade 5 (light and heavy), and Grade 6 residual fuels. Middle distillates specifications are described in ASTM D-975, for automotive applications (the entire teaching of which is incorporated herein by reference), and ASTM D-396, for burner applications (the entire teaching of which is incorporated herein by reference).

Middle distillates fuels for aviation are designated by such terms as JP-4, JP-5, JP-7, JP-8, Jet A, Jet A-1. JP-4 and JP-5. The Jet fuels are defined by U.S. military specification MIL-T-5624-N, the entire teaching of which is incorporated herein by reference and JP-8 is defined by U.S. Military Specification MIL-T83133-D the entire teaching of which is incorporated herein by reference. Jet A, Jet A-1 and Jet B are defined by ASTM specification D-1655 and Def. Stan. 91, the entire teachings of which are incorporated herein by reference.

These petroleum fuels as described can comprise blends with Bio based fuels. The bio based components as part of the fuel blend are commonly known as Bio Diesel. Bio Diesel as defined by ASTM specification D-6751 (the entire teachings of which are incorporated herein by reference) is a fatty acid mono alkyl esters of vegetable or animal oils. Common oils used in Bio Diesel production are Rapeseed, Soya, Palm Tallow, Sunflower, and used cooking oil or animal fats.

The different fuels described (Engine fuels, Burner fuels and Aviation Fuels) each have further to their specification requirements (ASTM D-975, ASTM D-396 and D-1655 respectively) allowable sulfur content limitations. These limitations are generally on the order of up to 15 ppm of sulfur for On-Road fuels, up to 500 ppm of sulfur for Off-Road applications and up to 3000 ppm of sulfur for Aviation fuels.

Synergy as defined in the present embodiment is the increase in conductivity of a hydrocarbon fluid by the addition of a combination of two or more components, resulting in a greater increase in conductivity than that is directly attributable to cumulative (or additive) increases in the conductivity of the same hydrocarbon fluid by the addition of each component separately.

In the present embodiment, the Combination of Lubricity and Conductivity additives is defined as a blend of a Lubricity additive and a Conductivity additive into a single package or formulation.

Lubricity:

Fuel lubricity is the ability of the fuel to prevent wear on contacting metal surfaces. Certain diesel engine designs rely on fuel as a lubricant for their internal moving components. Reducing the level of one or more of the sulfur, polynuclear aromatic or polar components of diesel fuel oil can reduce the ability of the fuel to lubricate the injection system of the engine causing the fuel injection pump of the engine to fail prematurely. Even marginally lower lubricity can significantly increase wear of fuel pumps, valves and injector nozzles over an extended period of use.

In the present embodiment, Lubricity additives are described as any chemical species which are either present or added to hydrocarbon fluids to increase the lubricity of such hydrocarbon fluids.

Suitable chemicals that can serve as lubricity improver additives are components derived from chemical families that include: long chain fatty acid, derivatives of such fatty acids to include salts (both mineral and organic), amides and esters; polymeric analogs of organic acids known as dimer/trimer acids, derivatives of such polymeric analogs to include salts (both mineral and organic), amides and esters; and poly and alkyl amines (which are generally known as "filming amines") and their derivatives such as amides, salts, and oxyalkylates. Lubricity can be supplied to the fuel by the use of other polar fuel additives, particularly corrosion inhibitors.

Lubricity additives considered as part of this invention are described as organic acids, and esters and amides of organic acids. In one aspect, the Lubricity additive can be represented by general formula:

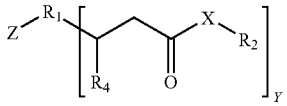

wherein;

$R_1$ can be alkyl-linear, branched, saturated, unsaturated, $C_{1-40}$; aromatic, cyclic, polycyclic;

$R_2$ can be alkyl-linear, branched, saturated, unsaturated, $C_{1-40}$; aromatic, cyclic, polycyclic, H, or analogs of $R_3$—$NH_2$ or $R_3$—OH;

$R_3$ can be alkyl-linear, branched, saturated, unsaturated, $C_{1-40}$; aromatic, cyclic, polycyclic, repeating units based on ethylene, propylene or butylene oxide, or repeating units based on ethylene, propylene or butylene aziridine;

$R_4$ can be alkyl-linear, branched, saturated, unsaturated, $C_{1-40}$; aromatic, cyclic, polycyclic; H, $R_3$—OH; Alcohol; Ester; or an Acid;

X can be O, NH, $NR_1$, S, or P;

Y can be 1-6; and

Z can be organic functional groups (H, alcohols, aldehydes, ketones, acids, esters, amides, amines, imides, ester amines, amido amines, imido amines, imidazolines, carbamates, ureas, imines, and enamines) present on the $R_1$ hydrocarbon backbone.

Suitable Lubricity additives are described in the literature. A few representative examples include: U.S. Pat. No. 6,793,696 fatty acids with short chain oil-soluble amines, U.S. Pat. No. 6,872,230 an alkylated polyamine and (ii) urea or isocyanate, or the salt adducts of these reaction products U.S. Pat. No. 6,733,550 reaction product of a polyalkenyl derivative of monoethylenically unsaturated $C_4$-$C_{10}$ dicarboxylic acid material in which the number average molecular weight ($M_n$) of the polyalkenyl chain is in the range from 850 to 1150 with (B) a polyamine of a general formula where m is in the range from 2 to 4 and n is in the range from 1 to 6; U.S. Pat. No. 6,656,237 fused polycyclic aromatic compound which comprises at least one exocyclic group containing nitrogen, U.S. Pat. No. 6,610,111 fatty acids with paraffin dispersants, U.S. Pat. No. 6,592,638 carboxylic acids, their derivatives and hydroxyl-containing polymers, U.S. Pat. No. 6,589,302 glyceride fatty acid esters, U.S. Pat. No. 6,562,086 fatty acid amides, U.S. Pat. No. 6,462,001 dimerized and/or trimerized fatty acids, U.S. Pat. No. 6,511,520 glycerol monoester, U.S. Pat. No. 6,458,173 poly(hydroxy-carboxylic acid) amide or -ester derivative, U.S. Pat. No. 6,328,771 carboxylic acid and heterocyclic aromatic amine, U.S. Pat. No. 6,293,977 polycarboxylic acids and epoxides, U.S. Pat. No. 6,277,159 substituted aromatic amine salt, U.S. Pat. No. 6,280,488 dispersant comprising an acylated nitrogen compound; and (b) a carboxylic acid, or an ester of the carboxylic acid and an alcohol, U.S. Pat. No. 6,224,642 fatty acid; a fatty acid amide; a fatty acid ester; an amide, imide or ester derived from a hydrocarbyl substituted succinic acid or anhydride, and U.S. Pat. No. 6,156,082 alkenyl succinic esters; the entire teachings of these patents are incorporated herein by reference.

Furthermore, lubricity can be supplied by the use of renewable cutter stock (ASTM specification D-6751, the entire teaching of which is incorporated herein by reference) to be blended into petroleum based fuel. This cutter stock is commonly known as Bio Diesel. Bio Diesel is defined as fatty acid alkyl esters of vegetable, or animal oils. Common oils used to produce Bio Diesel are Rapeseed, Soya, Palm Tallow, and Used Cooking Oils or Animal Fats.

In one aspect, a range in which a Lubricity additive is added to hydrocarbon fluids is from about 10.0 to about 10,000 mg/l. The additives are commonly present in a fuel between about 50 to about 300 mg/l of fuel. In another aspect, lubricity additive treatment range is from about 5.0 to about 500 mg/l of fuel. A typical treatment range is about 100 to about 250 mg/l of fuel.

In the present embodiment, Static Dissipaters (SD), Conductivity Improver (CI), or Anti Stats (AS) are defined as any chemical species which are either present or added to hydrocarbon fluids to increase the conductivity or the rate of charge dissipation in such hydrocarbon fluids. Conductivity additives considered as part of this invention are described products derived from the following chemistries alpha-olefin-sulfone copolymer class-polysulphone and quaternary ammonium salt, polysulphone and quaternary ammonium salt amine/epichlorhydrin adduct dinonylnaphthylsulphonic acid, copolymer of an alkyl vinyl monomer and a cationic vinyl monomer, alpha-olefin-maleic anhydride copolymer class, methyl vinyl ether-maleic anhydride copolymers and amines, alpha.-olefin-acrylonitrile, alpha-olefin-acrylonitrile copolymers and polymeric polyamines, and copolymer of an alkyl vinyl monomer and a cationic vinyl monomer and polysulfone, a Ethoxylated quat, hydrocarbyl monoamine or hydrocarbyl-substituted polyalkyleneamine, acrylic-type ester-acrylonitrile copolymers and polymeric polyamines, and diamine succinamide reacted with an adduct of a ketone and $SO_2$.

Suitable Static Dissipaters/Conductivity Improver additives exist and can be utilized pursuant to this invention have components derived from chemical families that include: aliphatic amines-fluorinated polyolefins (U.S. Pat. No. 3,652,238), chromium salts and amine phosphates (U.S. Pat. No. 3,758,283), alpha-olefin-sulfone copolymer class-polysulphone and quaternary ammonium salt (U.S. Pat. No. 3,811,848), polysulphone and quaternary ammonium salt amine/epichlorhydrin adduct dinonylnaphthylsulphonic acid (U.S. Pat. No. 3,917,466), copolymer of an alkyl vinyl monomer and a cationic vinyl monomer (U.S. Pat. No. 5,672,183), alpha-olefin-maleic anhydride copolymer class (U.S. Pat. Nos. 3,677,725 & 4,416,668), methyl vinyl ether-maleic anhydride copolymers and amines (U.S. Pat. No. 3,578,421), alpha.-olefin-acrylonitrile (U.S. Pat. Nos. 4,333,741 & 4,388,452), alpha-olefin-acrylonitrile copolymers and polymeric polyamines (U.S. Pat. No. 4,259,087), and copolymer of an alkylvinyl monomer and a cationic vinyl monomer and polysulfone (U.S. Pat. No. 6,391,070), an ethoxylated quat (U.S. Pat. No. 5,863,466), hydrocarbyl monoamine or hydrocarbyl-substituted polyalkyleneamine (U.S. Pat. No. 6,793,695), acrylic-type ester-acrylonitrile copolymers and polymeric polyamines (U.S. Pat. Nos. 4,537,601 & 4,491,651), diamine succinamide reacted with an adduct of a ketone and $SO_2$ (β-sutlone chemistry) (U.S. Pat. No. 4,252,542); the entire teachings of these patents are incorporated herein by reference.

Each additive type or family in the formulation is specifically chosen to be present in the fuel oil composition in an amount effective to improve the fuel oils conductivity and lubricity. Generally, the effective range in which the additive provides protection is dependant on fuel properties and composition.

In one aspect, the amount of Conductivity additive required to treat a fuel is about 0.5 to about 5 mg/l, or about between 0.025 to about 0.25 gallons of additive for 42,000 gallons of fuel. In another aspect, the additives are commonly present in the fuel between about 0.3 to about 5 mg/l of fuel. In yet another aspect, dosage range of conductivity additive is from about 0.7 to about 1 mg/l, or about between 0.03 to about 0.05 gallons of additive for 42,000 gallons of fuel.

It is further considered as part of this invention, a method of synergistically increasing the conductivity of a hydrocarbon fuel or solvent by metering into the fuel the missing synergistic component.

The invention can be practiced by simultaneously adding to the fuel a synergistic combination of a Lubricity and Conductivity additive package, or by adding to the fuel in succession, a Conductivity additive and a Lubricity additive (order is not important). The Conductivity and Lubricity additives can be added in any order, and at any point in the fuel production and handling process, e.g., for example, the Conductivity additive maybe added at the refinery and the Lubricity additive subsequently added at the terminal or even at the fueling rack. Another example is the blending of two or more fuels where one fuel contains a Conductivity additive and another contains a Lubricity additive. A further example is the addition to the fuel a single or multi component formulation containing a Conductivity additive and another single or multi component formulation containing a Lubricity additive.

Regardless of the order, location or method of addition, Conductivity and Lubricity addition can be simultaneously present in a given fuel. The Conductivity additive whether added as a single component or as part of a multicomponent package can eventually be present in the fuel in the range about of 0.05 to about 10 mg/l, and the Lubricity improver whether added as a single component or as part of multicomponent package can eventually be present in the fuel about 1 to about 1000 mg/l.

The synergistic enhancement of conductivity by these additives occurs once the additives are present in the hydrocarbon fluid regardless of the method, formulation, or order in which they were delivered to the hydrocarbon fluid.

It is additionally considered as part of the present invention the combination of additives comprising the synergistic combination of Lubricity and Conductivity additives described herein together with other suitable additives well known to those skilled in the art that are typically used in hydrocarbon fluids and fuel oils, such as: (a) low temperature operability/cold flow additives, (b) corrosion inhibitors, (c) cetane improvers, (d) detergents, and (e) dyes and markers (f) anti-icing additives, (g) demulsifiers/anti haze additives, (h) antioxidants, (i) metal deactivators, (j) biocides, and (k) thermal stabilizers.

Low temperature operability/cold flow additives are used in fuels to enable users and operators to handle the fuel at temperatures below which the fuel would normally cause operational problems. Examples of suitable additives are well known to those skilled in the art. Distillate fuels such as diesel fuels tend to exhibit reduced flow at low temperatures due in part to formation of waxy solids in the fuel. The reduced flow of the distillate fuel affects transport and use of the distillate fuels in refinery operations and internal combustion engine. This is a particular problem during the winter months and especially in northern regions where the distillates are frequently exposed to temperatures at which solid formation begins to occur in the fuel, generally known as the cloud point (ASTM D 2500, the entire teaching of which is incorporated herein by reference) or wax appearance point (ASTM D 3117, the entire teaching of which is incorporated herein by reference). The formation of waxy solids in the fuel will in time essentially prevent the ability of the fuel to flow, thus, plugging transport lines such as refinery piping and engine fuel supply lines. Under low temperature conditions during consumption of the distillate fuel, as in a diesel engine, wax precipitation and gelation can cause the engine fuel filters to plug resulting in engine inoperability. Example of Low temperature operability/cold flow marketed by Innospec Inc. of Newark, Del. is PPD 8500.

Corrosion Inhibitors are a group of additives which are utilized to prevent or retard the detrimental interaction of fuel and materials present in the fuel with engine components. Examples of suitable additives are well known to those skilled in the art. The additives used to impart corrosion inhibition to fuels generally also function as lubricity improvers. Examples of Corrosion Inhibitors marketed by Innospec Inc. of Newark, Del. are DCI 6A, and DCI 4A.

Corrosion Inhibitors are a group of additives which are utilized to prevent or retard the detrimental interaction of fuel and materials present in the fuel with engine components. The additives used to impart corrosion inhibition to fuels generally also function as lubricity improvers. These additives coat the surfaces of moving metal parts to inhibit interaction of the metals with water. This coating also functions as a lubricating barrier between moving metal parts and results in diminishment of wear.

Cetane Improvers are used to improve the combustion properties of middle distillates. Examples of suitable Cetane Improvers (or additives) are well known to those skilled in the art. As discussed in U.S. Pat. No. 5,482,518, the entire teachings of which are incorporated herein by reference, fuel ignition in diesel engines is achieved through the heat generated by air compression, as a piston in the cylinder moves to reduce the cylinder volume during the compression stroke. In the engine, the air is first compressed, then the fuel is injected into the cylinder. As the fuel contacts the heated air, it vaporizes and finally begins to burn as the self-ignition temperature is reached. Additional fuel is injected during the compression stroke and the fuel burns almost instantaneously, once the initial flame has been established. Thus, a period of time elapses between the beginning of fuel injection and the appearance of a flame in the cylinder. This period is commonly called "ignition delay" and must be relatively short in order to avoid "diesel knock". A major contributing factor to diesel fuel performance and the avoidance of "diesel knock" is the cetane number of the diesel fuel. Diesel fuels of higher cetane number exhibit a shorter ignition delay than do diesel fuels of a lower cetane number. Therefore, higher cetane number diesel fuels are desirable to avoid diesel knock. Most diesel fuels possess cetane numbers in the range of about 40 to about 55. A correlation between ignition delay and cetane number has been reported in "How Do Diesel Fuel Ignition Improvers Work" Clothier, et al., Chem. Soc. Rev, 1993, pg. 101-108, the entire teachings of which are incorporated herein by reference. Cetane improvers have been used for many years to improve the ignition quality of diesel fuels. Example of a Cetane Improvers marketed by Innospec Inc. of Newark Del. is CI-0801.

Detergents are additives which can be added to hydrocarbon fuels to prevent or reduce deposit formation, or to remove or modify formed deposits. Examples of suitable additives are well known to those skilled in the art. It is commonly known that certain fuels have a propensity to form deposits which may cause fuel injectors to clog and effect fuel injector spray patterns. The alteration of fuel spray patterns can result in non-uniform distribution and/or incomplete atomization of fuel resulting in poor fuel combustion. The accumulation of deposits is characterized by overall poor drivability including hard starting, stalls, rough engine idle and stumbles during acceleration. Furthermore, if deposit build up is allowed to proceed unchecked, irreparable harm may result which may require replacement or non-routine maintenance. In extreme cases, irregular combustion could cause hot spots on the pistons which can result in total engine failure requiring a complete engine overhaul or replacement. Examples of Detergents marketed by Innospec Inc. of Newark, Del. are DDA 350, and OMA 580.

Dyes and Markers are materials used by the EPA (Environmental Protection Agency) and the IRS (Internal Revenue Service) to monitor and track fuels. Examples of suitable dyes and/or markers are well known to those skilled in the art. Since 1994 the principle use for dyes in fuel is attributed to the federally mandated dying or marking of untaxed "off-road" middle distillate fuels as defined in the Code of Federal Regulations, Title 26, Part 48.4082-1 (26 CFR 48.4082-1). Dyes are also used in Aviation Gasoline; Red, Blue and Yellow dyes denote octane grade in Avgas. Markers are used to identify, trace or mark petroleum products without imparting visible color to the treated product. One of the main applications for markers in fuels is in Home Heating Oil. Examples of Dyes and Markers marketed by Innospec Inc. of Newark, Del. are Oil Red B4 and Oil Color IAR.

Anti-Icing additives are mainly used in the aviation industry and in cold climates. Examples of suitable additives are well known to those skilled in the art. They work by combining with any free water and lowering the freeze point of the mixture that no ice crystals are formed. Examples of Anti-Icing additives marketed by Innospec Inc, of Newark, Del. are Dri-Tech and DEGME.

Demulsifiers/Anti Haze additives are mainly added to the fuel to combat cloudiness problems which maybe caused by the distribution of water in a wet fuel by dispersant used in stability packages. Examples of suitable additives are well known to those skilled in the art, Examples of Demulsifiers/Anti Haze additives marketed by Innospec Inc. of Newark, Del. are DDH 10 and DDH 20.

Antioxidants are used to inhibit the degradation of fuels by interaction of the fuel with atmospheric oxygen. (Examples of suitable antioxidants are well known to those skilled in the art.) This process is known as "Oxidative Instability". The oxidation of the fuel results in the formation of alcohols, aldehydes, ketones, carboxylic acids and further reaction products of these functional groups, some of which may yield polymers. Antioxidants function mainly by interrupting free radical chain reactions, thus inhibiting peroxide formation and fuel degradation. Examples of Antioxidants additives marketed by Innospec Inc. of Newark, Del. are AO 37 and AO 29.

Metal Deactivators are chelating agents that form stable complexes with specific metals. Examples of suitable deactivators are well known to those skilled in the art. Certain metals (Copper, Zinc) are very detrimental to fuel stability as they catalyze oxidation processes resulting in fuel degradation (increase in gums, polymers, color, and acidity). Examples of Metal Deactivator marketed by Innospec Inc. of Newark, Del. is DMD.

Biocides are used to control microorganisms such as bacteria and fungi (yeasts, molds) which can contaminate fuels. Examples of suitable biocides are well known to those skilled in the art. These sorts of issues are generally a function of fuel system cleanliness, specifically water removal from tanks and low point in the system. Example of Biocide marketed by Innospec Inc. of Newark, Del. is 6500.

Thermal Stabilizers are additives which help prevent the degradation of fuel upon exposure to elevated temperatures. Examples of suitable additives are well known to those skilled in the art. Fuel during its use cycle is exposed to varying thermal stresses. These stresses are: In storage—where temperatures are low to moderate, 0 to 49° C. (32 to 120° F.), for long periods of time, 2) In vehicle fuel systems—where temperatures are higher depending on ambient temperature and engine system, 60 to 70° C. (140 to 175° F.), but the fuel is subjected to these higher temperatures for shorter periods of time than in normal storage, and 3) In (or near) the engine—where temperatures reach temperatures as high as 150° C. (302° F.) before injection or recycling, but for even shorter periods of time. Thermal stability additives protect the fuel uniformity/stability against these types of exposures. Examples of Thermal Stabilizers marketed by Innospec Inc. of Newark, Del. are FOA 3 and FOA 6.

The general chemistries and compositions of these additive families which function to impart the desired fuel characteristics are fully known in the art. A person having ordinary skill in the art to which this invention pertains can readily select an additive to achieve the enhancement of the desired fuel property.

During the research and development for formulating a combined Conductivity/Lubricity package, it was discovered that a certain combination of Lubricity and Conductivity additives had an unexpected synergistic affect on enhancing fuel conductivity.

The synergy described herein had heretofore been unknown in the fuel/fuel additives industry. The discovery of this synergistic interaction is very important in the fuel industry. Specifically, it allows the minimization of the required level of conductivity additives used to treat fuels.

The current invention discloses a fuel composition exhibiting enhance conductivity. The invention also describes the use of Lubricity and Conductivity additives to synergistically enhance the conductivity of a hydrocarbon fuel or solvent.

The invention is further described by the following illustrative but non-limiting examples. The following examples depict the synergistic enhancement of fuel conductivity by the proper combination of Lubricity and Conductivity additives.

EXAMPLES

Conductivity Test Method

Conductivity of the fuel is measured by using procedures outlined in ASTM D-2624 *Standard Test Methods for Electrical Conductivity of Aviation and Distillate Fuels*. The entire teaching of which is incorporated herein by reference

Synergy Test Method

The affect on conductivity upon combining a Lubricity additive with a Conductivity additive was evaluated. A series of Lubricity additives available in the fuel industry were added to #2 ULS Diesel fuel containing 1 mg/l of market available Conductivity additives. The base line conductivity of the fuel containing 1 mg/l of Conductivity additive was measured. The Lubricity additives were then dosed into the fuel at amounts equivalent to 5, 10, 50, 100, and 200 mg/l. The conductivity of the fuel containing Conductivity additive and Lubricity additive was then evaluated.

Static Dissipater I (Stadis® 450)

The affect on conductivity upon combining a Lubricity additive with a Conductivity additive was evaluated. The conductivity of the fuel with 1 mg/l of Stadis® 450 along with different levels of Lubricity additives is recorded in Table 1.

TABLE 1

| | Stadis ® 450 | 5 mg/L | 10 mg/L | 50 mg/L | 100 mg/L | 200 mg/L |
|---|---|---|---|---|---|---|
| T9125 | 172 | 168 | 171 | 173 | 181 | 206 |
| MCC 2200 | 158 | 163 | 165 | 159 | 159 | 168 |
| R690 | 171 | 175 | 169 | 123 | 92 | 96 |
| OLI-9070x | 167 | 192 | 199 | 221 | 250 | 280 |
| T9127 | 175 | 196 | 175 | 157 | 139 | 122 |
| T9137 | 125 | 153 | 168 | 166 | 167 | 177 |

T9125 is a product produced by Baker Petrolite, it is believed to be mono fatty amide
MCC 2200 - is a product produced by Lubrizol corp., it is believed to be an fatty acid
R690 is a product produced by Infenium, it is believed to be a dimmer trimer fatty acid di ester
OLI-9070x - is a product produced by Innospec, it is believed to be a alkyl succinic diester
T9127 - is a product produced by Baker Petrolite, it is believed to be fatty mix ester amide
T9137 - is a product produced by Baker Petrolite, it is believed to be fatty mix ester amide The data obtained was analyzed to evaluate the affect of additive combination on fuel conductivity. The percent change in conductivity with respect to the base fuel was calculated using the formula: Percent Change in Conductivity=Lubricity Additized Fuel Conductivity−Base Fuel Conductivity/Base Fuel Conductivity*100. The base fuel conductivity in this evaluation is defined as the conductivity of the #2 ULS Diesel with 1 mg/l of Stadis® 450 conductivity additive.

The results of the evaluation are depicted in FIG. 1.

The data indicates that there is a great effect on conductivity of the base fuel depending of the choice of lubricity additive. At all dose rates Lubricity additive R 690 had a great detrimental affect of fuel conductivity. The same detrimental affect is seen with additive T 9127, although not as pronounced as R 690. These two additives dramatically diminished the conductivity of the fuel by 42 percent and 30 percent respectively.

The additives which exhibited a synergistic affect were T 9125, T 9137 and OLI 9070.x, The T 9125 additive increased the fuel conductivity by 20 percent, T 9137 additive increased the fuel conductivity by 40 percent. The OLI 9070.x exhibited a linear increase in conductivity with increasing dosing levels. The additive had the greatest enhancing affect on fuel conductivity, increasing the conductivity by 64%.

The data clearly exemplifies the need to correctly match Lubricity and Conductivity additives in order to obtain the greatest level of synergistic interaction.

Static Dissipater II (Stadis® 425)

The affect on conductivity upon combining a Lubricity additive with a Conductivity additive was evaluated. The conductivity of the fuel with 1 mg/l of Stadis® 425 along with different levels of Lubricity additives is recorded in Table 2.

TABLE 2

| | Stadis ® 425 | 5 mg/L | 10 mg/L | 50 mg/L | 100 mg/L | 200 mg/L |
|---|---|---|---|---|---|---|
| T9125 | 92 | 95 | 88 | 73 | 74 | 84 |
| T9127 | 102 | 108 | 90 | 65 | 49 | 45 |
| MCC | 104 | 107 | 96 | 74 | 74 | 82 |
| R690 | 109 | 99 | 94 | 53 | 52 | 52 |
| OLI-9070x | 107 | 96 | 94 | 90 | 106 | 130 |
| T9137 | 114 | 116 | 110 | 94 | 87 | 84 |

T9125 is a product produced by Baker Petrolite, it is believed to be mono fatty amide
MCC 2200 - is a product produced by Lubrizol corp., it is believed to be an fatty acid
R690 is a product produced by Infenium, it is believed to be a dimmer trimer fatty acid di ester
OLI-9070x - is a product produced by Innospec, it is believed to be a alkyl succinic diester
T9127 - is a product produced by Baker Petrolite, it is believed to be fatty mix ester amide
T9137 - is a product produced by Baker Petrolite, it is believed to be fatty mix ester amide The data obtained was analyzed to evaluate the effect of additive combination on fuel conductivity. The percent change in conductivity with respect to the base fuel was calculated using the formula: Percent Change in Conductivity=Lubricity Additized Fuel Conductivity−Base Fuel Conductivity/Base Fuel Conductivity*100. The base fuel conductivity in this evaluation is defined as the conductivity of the #2 ULS Diesel with 1 mg/l of Stadis® 425 conductivity additive.

Figure 2:
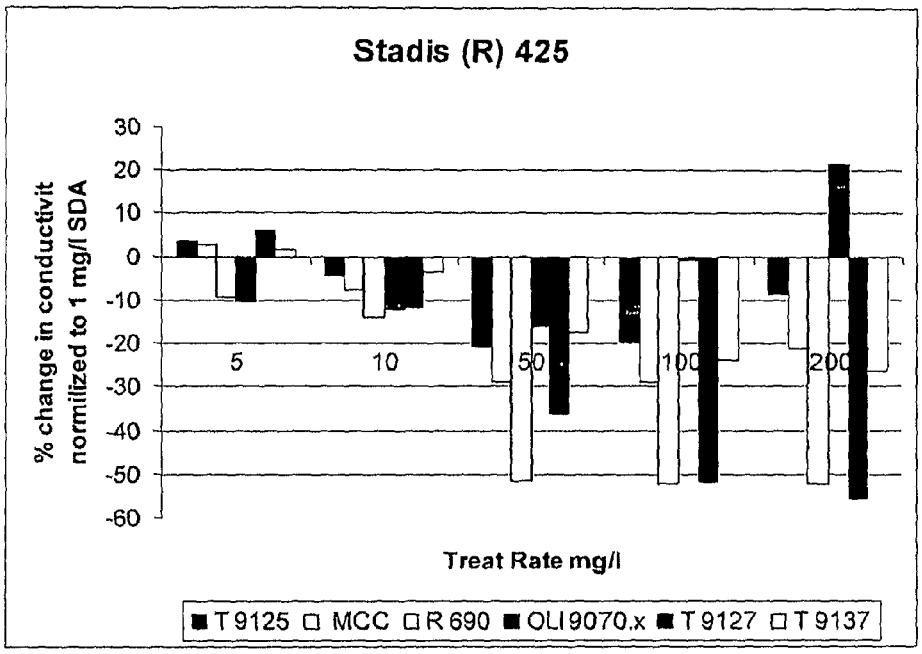
FIG. 2 is a graphical representation of the affect of lubricity additives on Stadis® 425 conductivity response.

The results of the evaluation are depicted in FIG. 2.

The data indicates that the majority of the currently used lubricity additives in the market had a detrimental effect on fuel conductivity using Stadis® 425 conductivity improver. The only additive which shoved a synergy with Stadis® 425 was OLI 9070.x. The data clearly exemplifies the need to correctly match lubricity and conductivity additives in order to obtain the greatest level of synergistic interaction.

Lubricity Additive (OLI 9070.x)

The conductivity of #2 ULS Diesel containing 1 mg/l of conductivity additive and lubricity 5, 10, 50, 100, and 200 mg/l of OLI 9070.x was compared to the same #2 ULS Diesel containing only lubricity additive. The data obtained was analyzed to evaluate the affect on percent change in conductivity with respect to the base fuel.

The calculation was performed using the formula: Conductivity Difference=Lubricity additized fuel conductivity−Base fuel conductivity. In the case of OLI 9070.x with Stadis®, the base fuel was #2 ULS Diesel containing 1 mg/l Stadis®, in the case of OLI 9070.x, the base fuel was the untreated #2 ULS Diesel.

Figure 3:
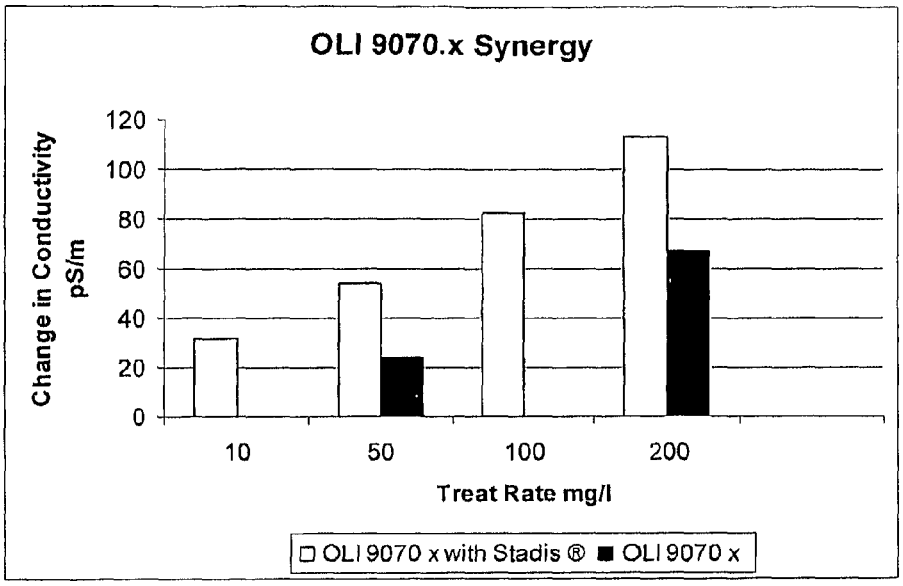
FIG. 3 is a graphical representation of the affect of lubricity OLI 9070.x on fuel conductivity.

The results of the evaluation are depicted in FIG. 3.

The data indicates that the increase in conductivity of the fuel by the addition of lubricity additive OLI 9070.x was directly attributed to the synergy between the lubricity and the conductivity additive, and was not due to simple cumulative sum of the conductivity enhancements by each individual additive.

Lubricity Additive (Sylfat FA 2)

The conductivity of #2 ULS Diesel containing 1 mg/l of Conductivity additive (Stadis® 425 and T 3514) with 5, 10, 50, 100, and 200 mg/l of Sylfat FA 2 was measured. The results of the evaluation are recorded in Table 3

TABLE 3

| Sylfat FA 2 | | 5 mg/L | 10 mg/L | 50 mg/L | 100 mg/L | 200 mg/L |
|---|---|---|---|---|---|---|
| | SDA 425 | | | | | |
| pS/m | 110 | 111 | 112 | 111 | 110 | 112 |
| | T 3514 | | | | | |
| pS/m | 108 | 125 | 124 | 126 | 121 | 123 |

The data indicated that there was no synergistic effect on fuel conductivity by combining either of the Conductivity Additives with Tall Oil Fatty Acid.

Overall the experiments indicate that there is a synergy between Lubricity and conductivity additives. That the Lubricity additives and Conductivity additive have to be carefully selected to achieve the desired synergy.

While certain embodiments of the present invention have been disclosed in detail, it is to be understood that various modifications may be adopted without departing from the spirit of the invention or scope of the following claims.

The invention claimed is:

1. A fuel oil composition comprising:

a. a Petroleum Based Component, and b. a conductivity enhancing synergistic combination of Lubricity and Conductivity additives wherein said Conductivity additives are a mixture of polysulphone and quaternary ammonium salt or a mixture of polysulphone and quaternary ammonium salt amine/epichlorhydrin adduct dinonylnaphthylsulphonic acid, said Lubricity additives are alkyl succinic esters or alkenyl succinic esters.

2. The fuel oil composition of claim 1, wherein said Petroleum Based Component is a middle distillate fuel, a jet fuel, or a Fischer-Tropsch fuel.

3. The fuel oil composition of claim 1, wherein said Petroleum Based Component comprises less then about 500 ppm by mass of sulfur.

4. The fuel oil composition of claim 1, wherein said Petroleum Based Component comprises less then about 15 ppm by mass of sulfur.

5. The fuel oil composition of claim 1, wherein said Lubricity additive is present in the fuel between about 5 to about 200 mg/l of fuel.

6. The fuel oil composition of claim 1, wherein said Conductivity additive is present in the fuel between about 0.01 to about 100 mg/l of fuel.

7. The fuel oil composition of claim 1, wherein said Conductivity additive is present in the fuel between about 0.1 to about 15 mg/l of fuel.

8. The fuel oil composition of claim 1, wherein said Conductivity additive is present in the fuel between about 0.3 to about 5 mg/l of fuel.

9. A method of increasing the conductivity of a hydrocarbon fuel by metering into the fuel a conductivity enhancing synergistic combination of Lubricity and Conductivity additives wherein said Conductivity additives are a mixture of polysulphone and quaternary ammonium salt or a mixture of polysulphone and quaternary ammonium salt amine/epichlorhydrin adduct dinonylnaphthylsulphonic acid, said Lubricity additives are alkyl succinic esters or alkenyl succinic esters.

10. The method of claim 9, wherein said synergistic components are metered together.

11. The method of claim 9, wherein said synergistic components are metered separately.

12. The fuel composition of claim 1 further comprising additives selected from the group consisting of: (a) low temperature operability/cold flow additives (b) corrosion inhibitors (c) cetane improvers (d) detergents, (e) dyes and markers, (f) anti-icing additives (g) demulsifiers/anti haze additives (h) antioxidants (i) metal deactivators (j) biocides, and (k) thermal stabilizers.

13. A method of operating an internal combustion engine using as fuel for the engine a fuel oil composition as recited in claim 1.

14. The method of claim 13, wherein said fuel oil is a middle distillate fuel containing less than 500 ppm by mass of sulfur.

* * * * *